US012408773B1

(12) United States Patent
Teicher et al.

(10) Patent No.: US 12,408,773 B1
(45) Date of Patent: Sep. 9, 2025

(54) KIT FOR NON-DAMAGING WALL MOUNTING OF COLLAGE TILES

(71) Applicants: Mordechai Teicher, Hod Hasharon (IL); Ori Mishkal, Atlit (IL)

(72) Inventors: Mordechai Teicher, Hod Hasharon (IL); Ori Mishkal, Atlit (IL)

( * ) Notice: Subject to any disclaimer, the term of this patent is extended or adjusted under 35 U.S.C. 154(b) by 0 days.

(21) Appl. No.: 19/174,956

(22) Filed: Apr. 10, 2025

(51) Int. Cl.
*A47G 1/17* (2006.01)

(52) U.S. Cl.
CPC ..... *A47G 1/17* (2013.01)

(58) Field of Classification Search
CPC ..... A47G 1/17
USPC ..... 33/562–566
See application file for complete search history.

(56) References Cited

U.S. PATENT DOCUMENTS 3,239,178 A * 3/1966 Pompa ..... F16B 47/003 211/1
6,880,259 B1 * 4/2005 Schultz ..... A47G 1/205 33/1 G
7,532,771 B2 5/2009 Taylor
7,689,064 B2 3/2010 Miksovsky
8,397,411 B2 3/2013 Russo
8,976,198 B2 3/2015 Borders
9,275,479 B2 3/2016 Borders
9,361,720 B2 6/2016 Tang
9,424,811 B2 8/2016 Moll
9,668,595 B2 6/2017 Floyd
9,788,670 B2 10/2017 Wiseman
10,628,628 B2 4/2020 Borders
2003/0025920 A1 * 2/2003 Yamamoto ..... B42D 15/0073 358/1.18
2009/0139127 A1 * 6/2009 Southard ..... A47G 1/16 40/761
2010/0011602 A1 * 1/2010 Houssian ..... A47G 1/205 33/562
2010/0199598 A1 * 8/2010 Townsend ..... F16M 13/02 248/231.91
2015/0101226 A1 * 4/2015 Sarlitt ..... A47G 1/065 40/735
2023/0114635 A1 * 4/2023 Rao ..... B32B 9/042 248/467

* cited by examiner

*Primary Examiner* — Cassandra Davis

(57) ABSTRACT

A kit for mounting collage tiles on a wall. The kit includes, for each collage tile, at least one adhesive tile positioning plate to be adhered to the wall for guiding the positioning the tile on the wall. The kit also includes a poster having windows for accommodating the adhesive tile positioning plates and adhering them to the wall through the windows.

12 Claims, 6 Drawing Sheets

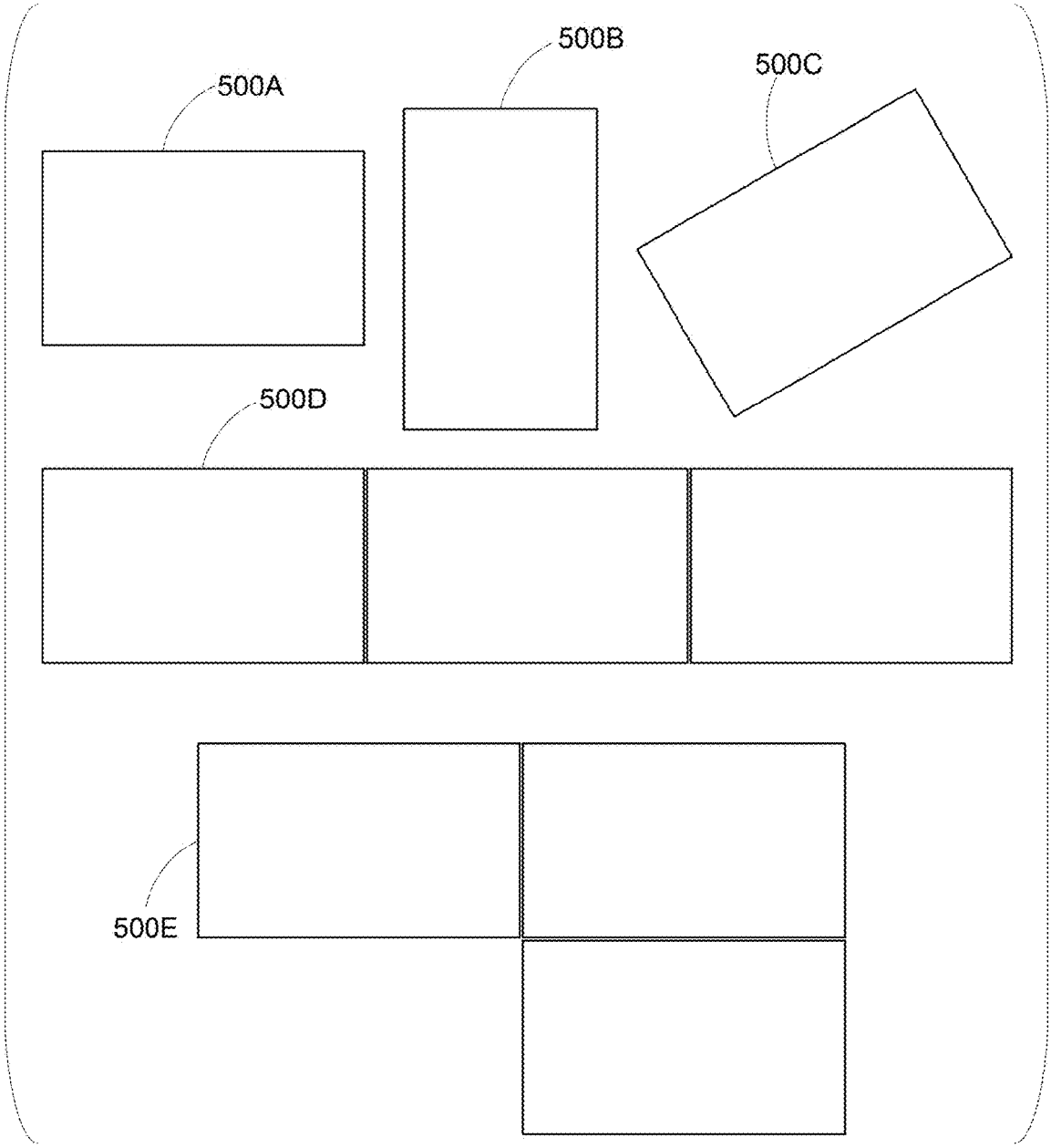
FIG. 5
FIG. 6
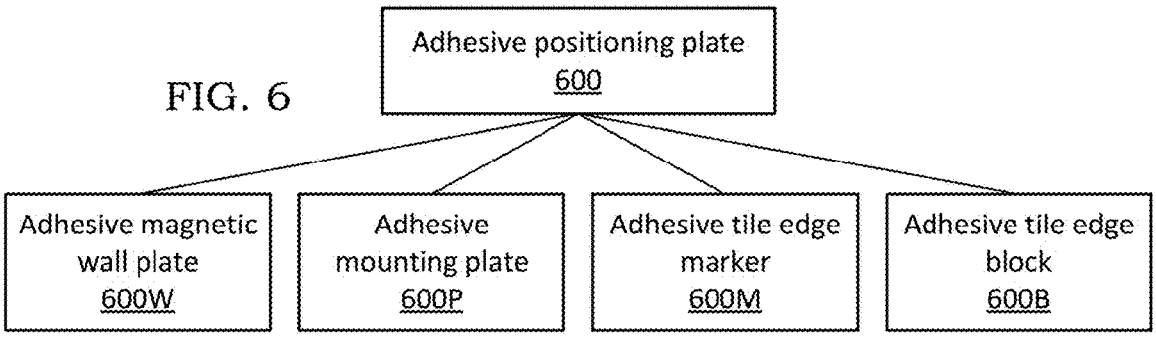

KIT FOR NON-DAMAGING WALL MOUNTING OF COLLAGE TILES

BACKGROUND OF THE INVENTION

Field of the Invention

The present application relates to non-damaging mounting of picture tiles on a wall, and in particular to facilitating accurate and convenient non-damaging mounting of collage tiles.

Description of Related Art

Individuals commonly adorn walls with tiles featuring pictures such as photographs, paintings, graphic art, text, diplomas, and similar items.

A collection of such tiles suspended on a wall constitutes a collage whose visual impact is contingent upon the contents of the pictures, as well as the shapes, relative sizes, and relative positions of the tiles.

The accurate mounting of tiles on a wall can be time-consuming, and may result in disappointment with the final visual outcome, or the discovery of an unsuitable location for the entire collage on the wall, necessitating tedious repositioning of all tiles.

Non-damaging tile mounting typically employs adhesive mounting plates that adhere to the wall without leaving any damage or residue upon removal.

FIG. 1A illustrates an adhesive mounting plate 52 of the background art, which comprises a carrier 58, such as a paper or thin foam carrier, affixed to the back of a tile segment 50 using adhesive tile layer 54T, and ready for removably adhering to a wall using adhesive wall layer 54W. Adhesive mounting plate 52 is often supplied pre-affixed to the top of a tile, so that the user peels a protective liner from adhesive wall layer 54W and presses the tile against the wall to adhere the tile to the wall.

Alternatively, FIG. 1B illustrates an adhesive magnetic mounting plate 72 of the background art that includes a magnetic tile plate 78T affixed by adhesive tile layer 74T to the back of tile segment 50, and an adhesive magnetic wall plate 78W having an adhesive wall layer 74W for removably adhering to a wall. These two magnetic plates are subsequently fastened to each other by magnetic attraction to effectively mount the tile on the wall. Such magnetic plates have gained popularity for mounting picture tiles on walls due to allowing fine adjustments of a tile's position and orientation, as well the easy non-damaging replacement of tiles. Magnetic plates 78T and 78W may be both made from magnetic material, or one of them may be made from magnetic material while the other is a thin metal plate such as an iron plate.

Adhesive magnetic mounting plate 72 is frequently supplied pre-affixed to a tile, so that the user peels a protective liner from the adhesive wall layer 74W and presses the tile against the wall to adhere it to the wall.

In both FIGS. 1A and 1B, tile segment 50 is a rigid portion of a tile. This could be, for example, the middle top of a rigid picture frame that encloses a paper picture or stretches a canvas, or the center of a foam board backing a picture.

SUMMARY OF THE INVENTION

The present specification seeks to provide apparatuses and methods for accurately and conveniently mounting collages on walls.

Definitions

"Picture" is herein a substrate, such as paper, exhibiting visual content such as a photograph, painting, graphic art, text, or diploma. "Picture tile", abbreviated "tile", is herein a physical object showcasing a picture and attached, or devised to be attached to a wall. A tile has a shape, such as a rectangle or a circle, and a size. For practical reasons, tile sizes may be constrained to several standard shapes and sizes that a user may select from. However, some embodiments may support tiles of user-definable shapes and sizes.

"Collage" herein is a collection of tiles attached to a wall, intended to collectively create a pleasing visual impression. "Collage snapshot" is a scaled-down replica of an intended collage, shown on a computer or smartphone screen or printed on a page of paper. "Collage template", also abbreviated "template", is a specification of the intended or actual shapes, sizes and relative positions of the tiles of a collage on a wall, and may be embodies in the form of a displayed or printed "collage layout" or "layout" that shows the collage tiles as line frames shaped and arranged according to the respective template.

"Adhesive tile positioning plate" is a plate related to a tile and adhered, or intended to be adhered to a wall at a designated location for assisting a user in positioning the respective tile on the wall according to the template. Examples of an adhesive tile positioning plate include adhesive magnetic wall plate, adhesive mounting plate, adhesive tile edge marker, and adhesive tile edge block, which will be described in the detailed description below.

BRIEF SUMMARY

The present specification teaches a kit for mounting a collage accurately and conveniently on a wall.

According to embodiments of the present invention, there is provided a kit for assisting a user in mounting multiple tiles of a collage on a wall. The kit includes a plurality of adhesive tile positioning plates, the plurality of tiles including, for each tile of the multiple tiles of the collage, at least one adhesive tile positioning plate operable to be adhered to the wall for positioning the tile on the wall. The kit further includes a poster operable to be attached by a user to the wall for determining the place of the collage on the wall so that it aesthetically integrates with other elements on the wall and in the neighboring space. The poster includes, for each adhesive tile positioning plate of the plurality of adhesive tile positioning plates: a window cut out through the poster and operable to accommodate the adhesive tile positioning plate and guide the adhesive tile positioning plate to adhere to the wall through the window. Subsequently, upon removal of the poster from the wall, each adhesive tile positioning plate adhered to the wall is operable to position a respective tile on the wall. By using the poster windows for accurately adhering the adhesive tile positioning plates to the wall, and then using the accurately adhered adhesive tile positioning plates to accurately position the tiles on the wall, the collage is ultimately mounted on the wall accurately and conveniently.

The poster may exhibit a full-size layout of the collage. At least one adhesive tile positioning plate of the plurality of adhesive tile positioning plates may be an adhesive magnetic wall plate operable to mate with a magnetic tile plate affixed to the respective tile. At least one adhesive tile positioning plate of the plurality of adhesive tile positioning plates may be an adhesive mounting plate operable to affix to a top edge of the respective tile. At least one adhesive tile positioning plate of the plurality of adhesive tile positioning plates may be an adhesive tile edge marker operable to visually mark on the wall a position of an edge of the respective tile. At least one adhesive tile positioning plate of the plurality of adhesive tile positioning plates may be an adhesive tile edge block operable to protrude from the wall to obstruct an edge of the respective tile. An adhesive tile edge block may be at least 2 mm thick. The poster may be composed of a single sheet. Alternatively, the poster may be composed of multiple sheets. At least one window cut out through the poster may be slanted relative to a side of the poster, for mounting the poster along a staircase. The kit may include the multiple tiles of the collage. The kit may include a mounting guidance page that shows a snapshot of the collage in which each tile of the collage is exhibiting its picture.

Also provided is a kit for assisting a user in mounting multiple tiles of a collage on a wall. The kit includes the multiple tiles of the collage; a plurality of adhesive tile positioning plates that includes, for each tile of the multiple tiles of the collage, at least one adhesive tile positioning plate operable to be adhered to the wall for positioning the tile on the wall, where at least one adhesive tile positioning plate of the plurality of adhesive tile positioning plates is an adhesive magnetic wall plate operable to mate with a magnetic tile plate affixed to the respective tile. Also included is a poster operable to be attached to the wall for placing the collage on the wall, the poster may include: for each adhesive tile positioning plate of the plurality of adhesive tile positioning plates: a window cut out through the poster and operable to accommodate the adhesive tile positioning plate and guide the adhesive tile positioning plate to adhere to the wall through the window, where, upon removal of the poster from the wall, each adhesive tile positioning plate adhered to the wall is operable to position a respective tile on the wall.

Also provided is a kit for assisting a user in mounting multiple tiles of a collage on a wall. The kit includes the multiple tiles of the collage; a plurality of adhesive tile positioning plates that includes, for each tile of the multiple tiles of the collage, at least one adhesive tile positioning plate operable to be adhered to the wall for positioning the tile on the wall, where at least one adhesive tile positioning plate of the plurality of adhesive tile positioning plates is an adhesive tile edge block operable to protrude from the wall to obstruct an edge of the respective tile. Also included is poster operable to be attached to the wall for placing the collage on the wall, the poster may include: for each adhesive tile positioning plate of the plurality of adhesive tile positioning plates: a window cut out through the poster and operable to accommodate the adhesive tile positioning plate and guide the adhesive tile positioning plate to adhere to the wall through the window, where, upon removal of the poster from the wall, each adhesive tile positioning plate adhered to the wall is operable to position a respective tile on the wall.

BRIEF DESCRIPTION OF THE DRAWINGS

The present invention will be understood and appreciated more fully from the following detailed description, taken in conjunction with the drawings in which:

FIG. 5 illustrates examples of posters made of one or more sheets.

FIG. 6 illustrates four examples of adhesive tile positioning plates.

DETAILED DESCRIPTION

Screen for Designing a Collage

Figure 2A:
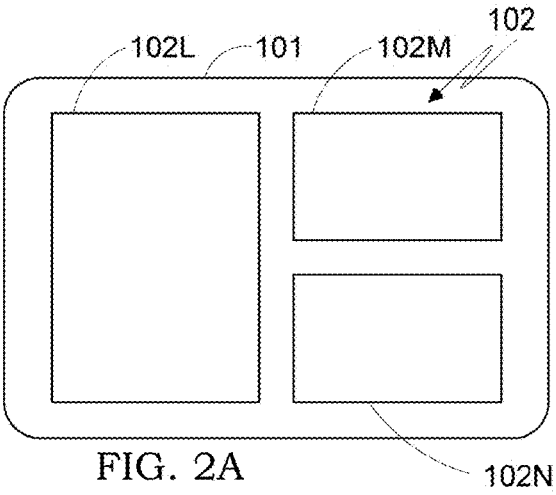
FIGS. 2A-2B illustrate a computer screen used for designing a collage.

Reference is made to FIG. 2A that schematically illustrates a screen 101 that is a computer or smartphone screen for selecting or authoring a collage template 102 and populating the template with pictures such as photographs, paintings, graphic art, text, or diplomas. In some embodiments, collage template 102 may be a standard template selectable from a template catalog. In some other embodiments, collage template 102 may be designed or edited by the user. Collage template 102 is made of frames shown on screen 101, in the present example frames 102L, 102M and 102N, representative of picture tiles that may be, for example, rectangular, square, round, or oval, and be characterized by shape, size and orientation such as portrait or landscape. A single template may include different frame shapes, sizes and orientations. Collage template 102 also specifies the relative position of all frames within collage template 102, which also determines tiles' spacings and alignments.

Figure 2B:
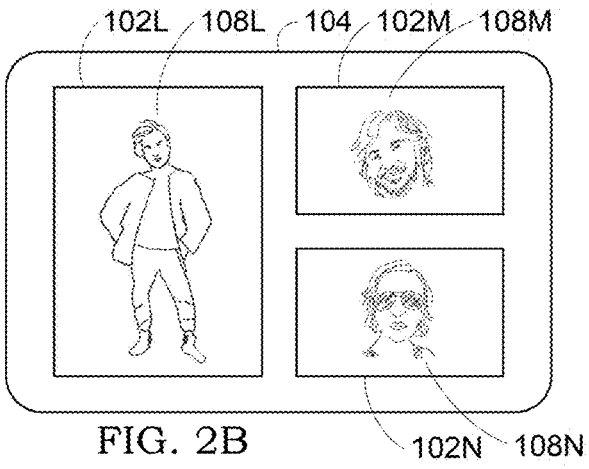

FIG. 2B shows collage design 104 on the screen of FIG. 2A, where frames 102L, 102M and 102N are populated with pictures 108L, 108M and 108N respectively, the pictures selected, and possibly edited, by the user, or, in some embodiments, selecting and/or editing the pictures may be facilitated or even entirely executed and suggested by software such as AI (artificial intelligence) based software.

A Kit Using Magnetic Plates for Mounting Tiles on a Wall

Figure 2C:
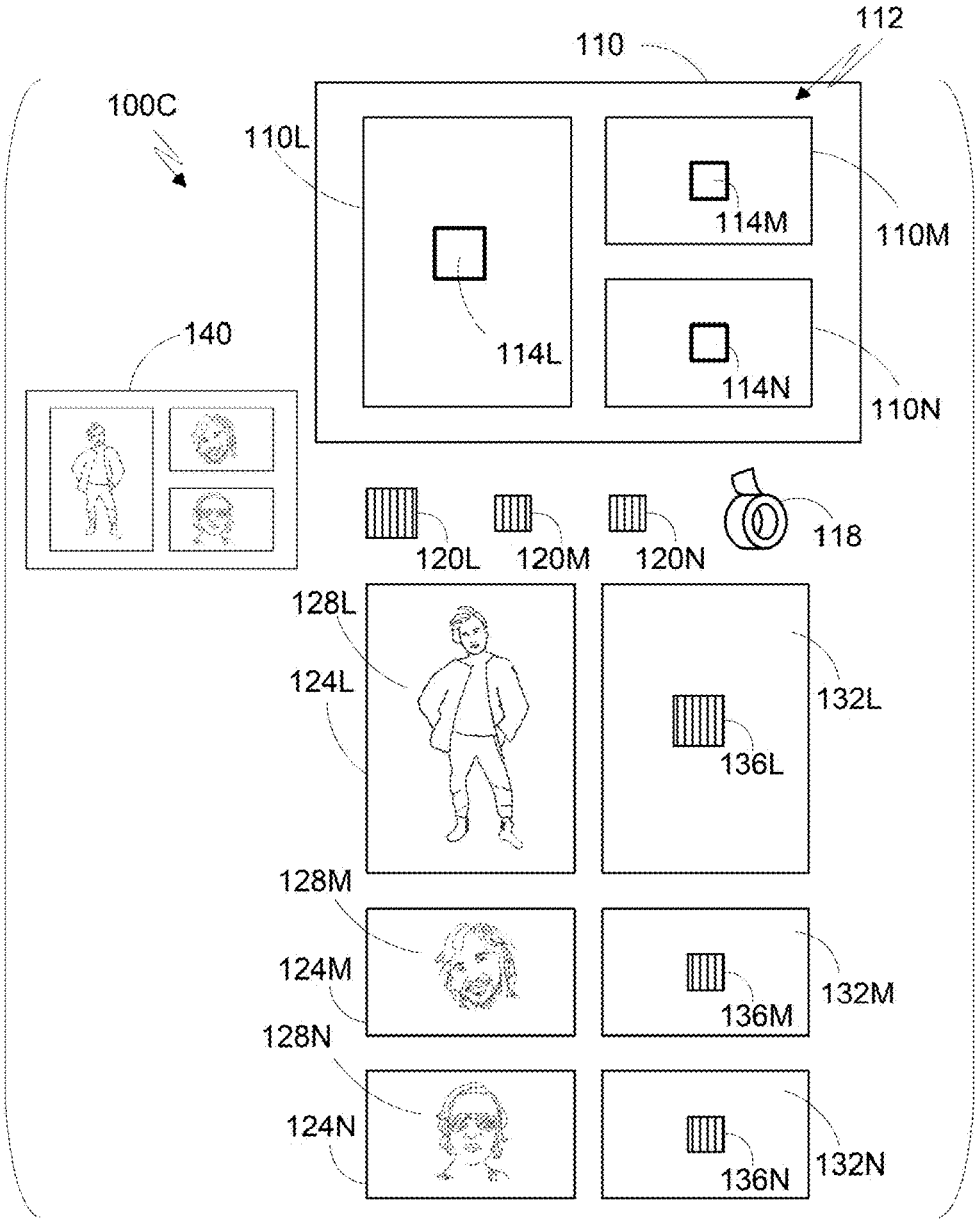
FIG. 2C-2F illustrate example kits for mounting collage tiles on a wall.

FIG. 2C depicts an example kit 100C intended to implement collage design 104 of FIG. 2B as a collage of tiles mounted on a wall, and assist a user in mounting the collage tiles on the wall. Kit 100C of the present example includes poster 110; three tiles 124L, 124M and 124N; three adhesive magnetic wall plates 120L, 120M and 120N serving as adhesive tile positioning plates; adhesive tape 118; and collage snapshot page 140.

Poster 110 is a sheet of paper, or another suitable substrate, that exhibits full-size printed layout 112 exhibiting full-size printed poster frames 110L, 110M and 110N relatively sized and positioned according to collage template 102. Each poster frame 110L, 110M and 110N has at least one corresponding window 114L, 114M and 114N cut out through the poster for accommodating, guiding the wall the corresponding adhesive magnetic wall plate 120L, 120M or 120N, respectively, to be adhered to the wall through the window. In some embodiments, a printed frame of poster 110 may have more than one window to accommodate more than one adhesive magnetic wall plate for mounting the respective tile on a wall. In some embodiments, each poster frame 110L, 110M and 110N may also exhibit a printed representation of the respective picture, in a form such as a black-and-white line drawing, to provide the user with a full-size preview of the collage.

Tiles 124L, 124M and 124N exhibit full-size pictures 128L, 128M and 128N, respectively on their front sides, while magnetic tile plates 136L, 136M and 136N are affixed to the tiles' back sides 132L, 132M and 132N, respectively. Adhesive magnetic wall plates 120L, 120M and 120N match the sizes of their respective magnetic tile plates 136L, 136M and 136N and are intended for passing through their corresponding poster windows 114L, 114M and 114N toward being adhered to the wall at locations displayed on the poster as full-size printed layout 112. Adhesive tape 118 is optionally included to be used by a user for temporarily attaching poster 110 to the wall; alternatively, poster 110 may be supplied with peelable removable stickers at its corners for temporarily attaching poster 110 to the wall. Optional collage snapshot page 140 is a printed page, for example of A4 or US Letter size, that shows a snapshot of collage design 104 of FIG. 2B, to guide the user in selecting and orienting tiles while mounting tiles 124L, 124M and 124N on a wall.

The shapes and sizes of windows 114L, 114M and 114N within poster frames 110L, 110M and 110N respectively, match the shapes and sizes of the corresponding adhesive magnetic wall plates 120L, 120M and 120N so that each magnetic plate passes through while being accurately guided by its corresponding window. The positions of windows 114L, 114M and 114N within poster frames 110L, 110M and 110N respectively, determine the positions of adhesive magnetic wall plates 120L, 120M and 120N on the wall, hence ultimately determine the positioning of the tiles 124L, 124M and 124N on the wall, when the poster is removed from the wall and magnetic tile plates 136L, 136M and 136N affixed to the back sides 132L, 132M and 132N of the respective tiles mate with the respective adhesive magnetic wall plates 120L, 120M and 120N adhered to the wall, ultimately exhibiting on the wall a collage of pictures 128L, 128M and 128N in accordance to collage template 102 of FIG. 2A and collage design 104 of FIG. 2B.

Magnetic plate pairs, such as magnetic tile plate 136L and adhesive magnetic wall plate 120L, may be both made of magnetic material, or one of them may be made of magnetic material while the other being a metal plate such as a thin iron plate.

Positions, Shapes and Sizes of Windows within Poster Frames

Figure 2D:
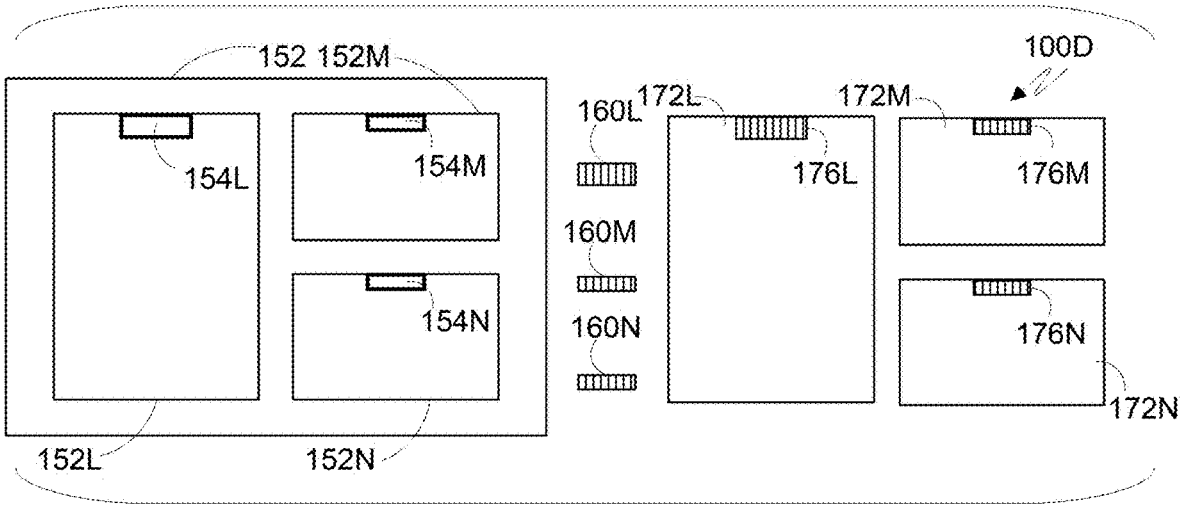
Figure 2E:
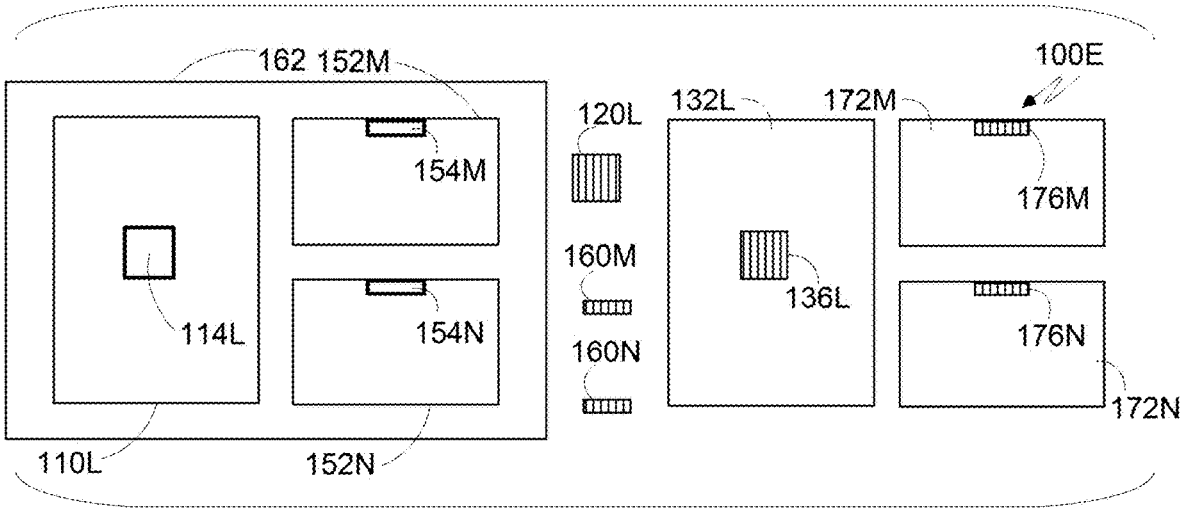

FIGS. 2D-2E illustrate kits with additional examples of positions, shapes and sizes of windows within poster frames, as well as the corresponding shapes and sizes of magnetic wall plates and the positions of magnetic tile plates on tiles' backs.

FIG. 2D illustrates kit 100D where windows are positioned at the middle top side of respective poster frames. Windows 154L, 154M and 154N are centered at the top side of poster frames 152L, 152M and 152N, respectively and are shaped and sized to accommodate and guide magnetic wall plates 160L, 160M and 160N, respectively, which match the shapes and sizes of magnetic tile plates 176L, 176M and 176N, respectively, affixed to tile back sides 172L, 172M and 172N, respectively.

FIG. 2E illustrates kit 100E that combines the arrangements of FIGS. 2C and 2D. Thus poster 162 includes poster frame 110L with window 114L; poster frame 152N with window 154M; and poster frame 152M with window 154N from FIGS. 2C-2D. Kit 100E also includes adhesive magnetic wall plates 120L, 160M and 160N, and magnetic tile plates 136L, 136M, and 136N from FIGS. 2C-2D.

Generally, centering magnetic tile plates on the back of tiles and correspondingly centering windows within poster frames is suitable for tiles made of foam boards or other solid materials. Positioning magnetic tile plates at the top of tiles' backs and windows at the top of poster frames is suitable for tiles made of rigid frames that enclose a paper picture or stretch a canvas picture, but it can also be used for tiles made of foam boards or other rigid materials.

A Kit Using Adhesive Mounting Plates for Positioning Tiles on a Wall

Figure 1A:
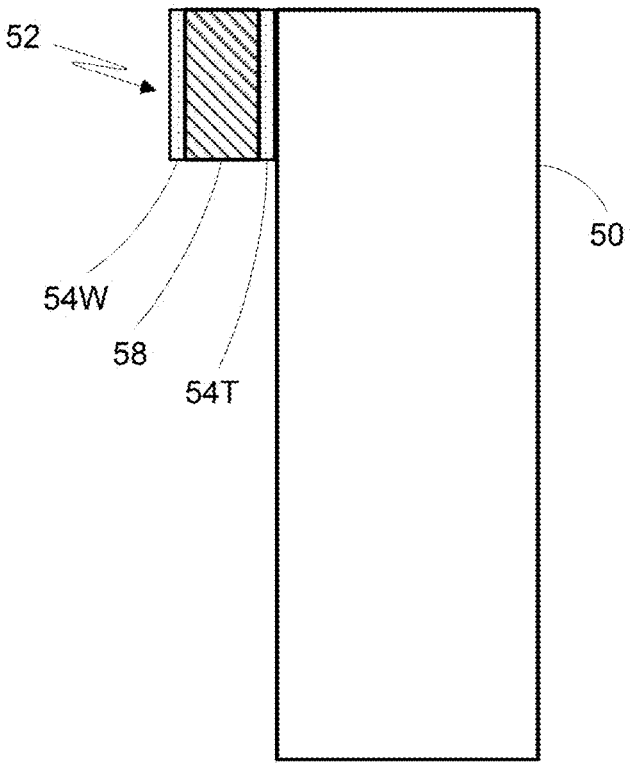
FIG. 1A (BACKGROUND ART)
FIGS. 1A-1B illustrate adhesive magnetic mounting plates of the background art.
Figure 1B:
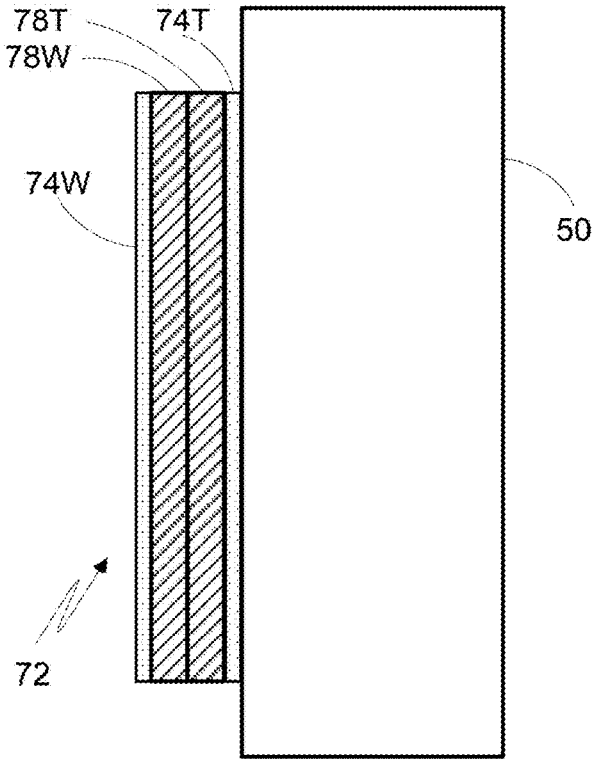
FIG. 1B (BACKGROUND ART)
Figure 2F:
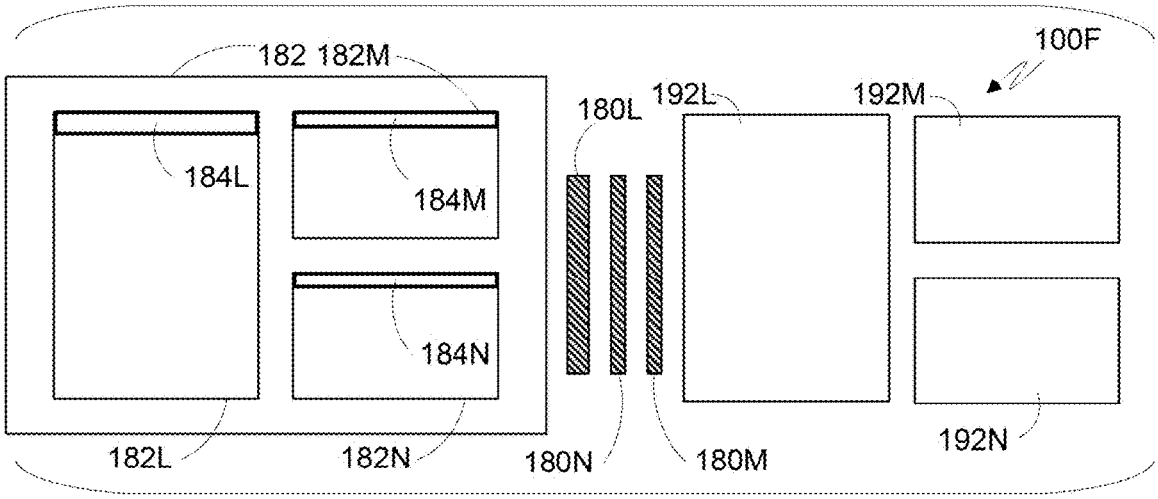

FIG. 2F illustrates kit 100F that uses poster 182 for positioning adhesive mounting plates 180L, 180M and 180N toward adhering them to a wall. Adhesive mounting plates 180L, 180M and 180N are similar to adhesive mounting plate 52 of FIG. 1A (background art), and their sizes match the sizes of windows 184L, 184M and 184N, respectively. Windows 184L, 184M and 184N have the widths of and are positioned at the top of frames 182L, 182M and 182N of poster 182. Tile back sides 192L, 192M and 192N are plain with no magnetic or adhesive fasteners of their own, and are ready for their top edges being aligned by a user with adhesive mounting plates 180L, 180M and 180N that have already been adhered to the wall, and pressed for ultimately affixing the tiles to the wall according to the template represented by poster 182.

Kits that Use Adhesive Tile Positioning Guides

An adhesive tile positioning guide is a plate for temporarily adhering to a wall adjacent to an intended edge of a tile, to guide positioning the tile by a user toward adhering the tile to the wall.

Figure 3A:
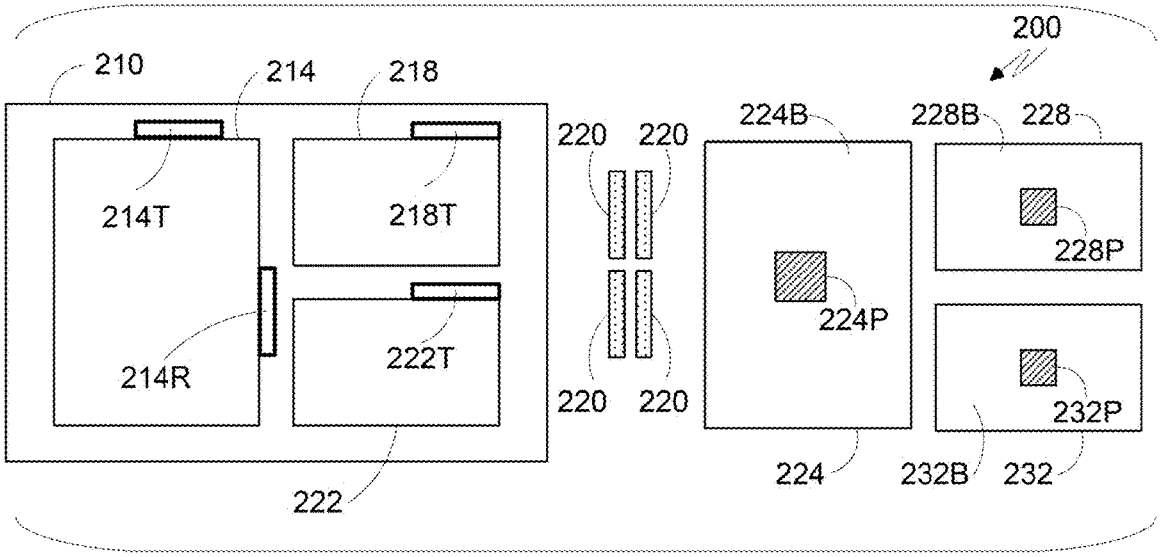
FIGS. 3A-3D illustrate a kit using adhesive tile positioning guides.

FIG. 3A illustrates an example kit 200 that comprises a poster, three tiles and four adhesive tile positioning guides. Poster 210 has three frames 214, 218 and 222. Frame 214 has two windows 214T and 214R, that are externally touching frame 214, intended to accommodate and guide positing of two adhesive tile positioning guides 220. Each of frame 218 and frame 222 has just a single window 218T and window 222T, respectively, intended to accommodate and guide positioning of a single adhesive tile positioning guide 220. If only a single adhesive tile positioning guide is used for positioning a tile, as is the case with frame 218 and frame 222, the edge of the respective window is preferably aligned with the corner of the frame, so that the edge of the respective adhesive tile positioning guide 220 identifies the corner of the respective tile, as demonstrated by adhesive tile positioning guide 220C and tile 228, and by adhesive tile positioning guide 220D and tile 232. Choosing between applying just a single window/adhesive tile positioning guide per frame/tile or two or more windows/tiles is a matter of design preference, and both are demonstrated by kit 200. The three tiles of kit 200 are preferably supplied to users with adhesive plates 224P, 228P, and 232P, such as adhesive mounting plate 52 of FIG. 1A or adhesive magnetic mounting plate 72 of FIG. 2A, pre-affixed to their back sides 224B, 228B, and 232B.

Figure 3B:
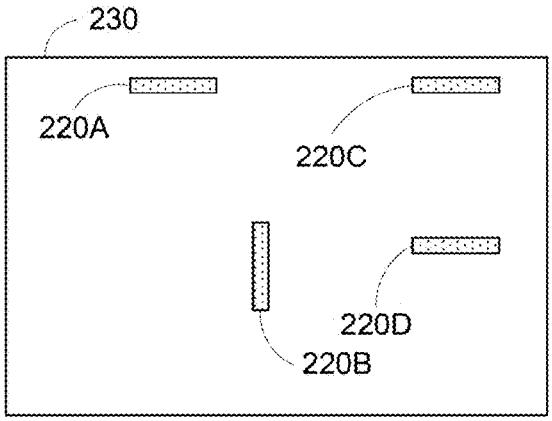

A user selects a wall area 230 of FIG. 3B for adhering poster 210 of kit 200 of FIG. 3A, and positions and temporarily attaches poster 210 over wall area 230 according to personal taste. Having the poster in place, the user adheres the four adhesive tile positioning guides 220 to the wall through windows 214T, 214R, 218T, and 222T, possibly using a collage snapshot page such as collage snapshot page 140 of FIG. 2C for guidance, and then removes poster 210 to leave the four adhesive tile positioning guides 220A, 220B, 220C, and 220D on the bare wall area 230 as shown in FIG. 3B.

Figure 3C:
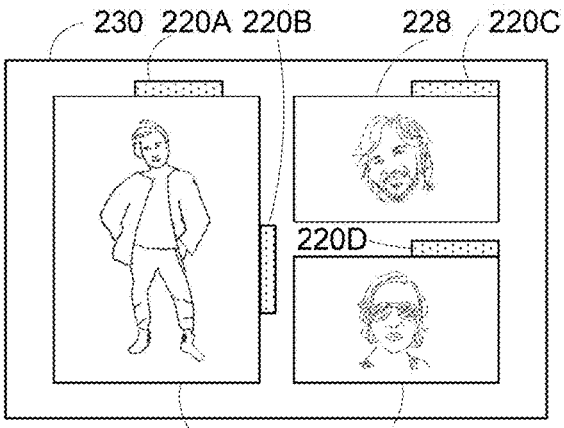

FIG. 3C demonstrates how the four adhesive tile positioning guides 220A, 220B, 220C, and 220D enable accurate positioning of tiles 224, 228 and 232 on wall area 230, each tile then pressed against the wall so that its respective adhesive plate 224P, 228P, 232P adheres to the wall thereby accurately mounting the tile according to the template embodied in poster 210.

Figure 3D:
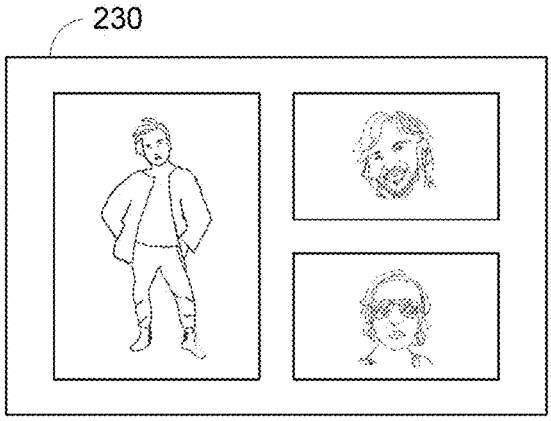

In FIG. 3D the four adhesive tile positioning guides 220A, 220B, 220C, and 220D of FIG. 3C have been removed, ultimately leaving the collage accurately mounted on wall area 230.

Types of Adhesive Tile Positioning Guides

Figure 3E:
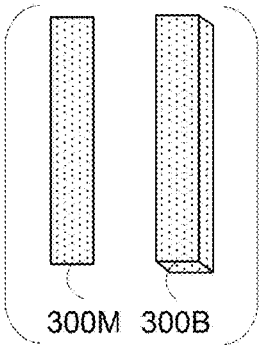
FIG. 3E illustrates two types of adhesive tile positioning guides.

FIG. 3E schematically depicts two example types of adhesive tile positioning guides 220 of FIGS. 3A-3C. Adhesive tile edge marker 300M, such as an adhesive color stripe, is affixed to wall area 230 as a visual aid for guiding the user in positioning a tile edge or a tile corner on the wall. Adhesive tile edge block 300B protrudes above the wall surface, to tangibly obstruct the respective tile edge at the intended border of the respective template frame according to poster 210 of FIG. 3A. As an example, adhesive tile edge block 300B may be made of cardboard or plastic or foam and have a thickness of at least 2 mm. It will be noted that while adhesive tile edge block 300B of FIG. 3E has a rectangular cross section, adhesive tile edge blocks of other cross sections, such as triangular or circular, may also work well.

Mounting a Collage Along a Staircase or Slanted Ramp

Figure 4A:
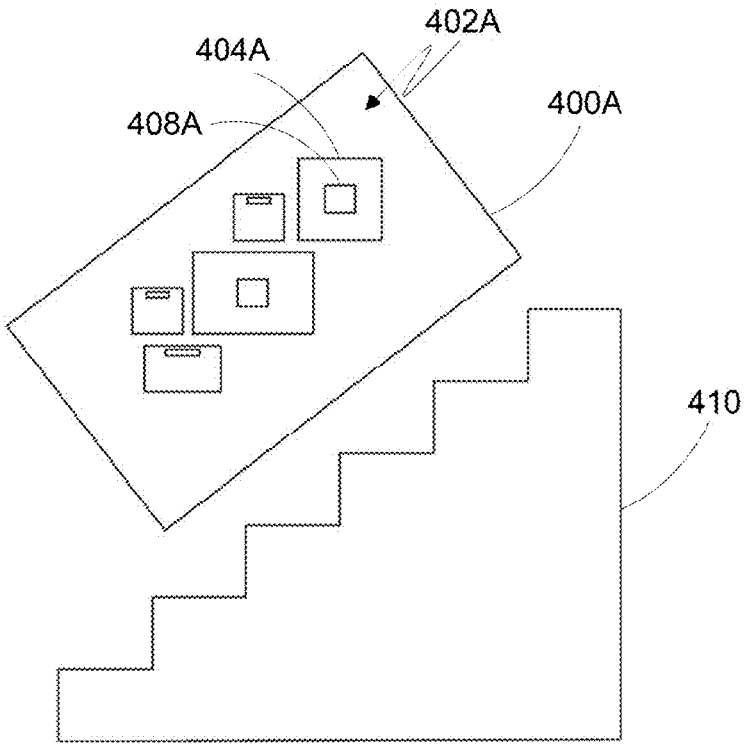
FIGS. 4A-4B illustrate a poster for mounting a collage along a staircase or slanted ramp.

In some embodiments, it is desired to mount a collage along a staircase or a slanted ramp. FIG. 4A schematically illustrates a staircase 410 and a poster 400A intended for adhering along staircase 410 in parallel to the staircase. The frames and windows included in poster layout 402A, such as poster frame 404A and window 408A, are leveled with the ground.

Figure 4B:
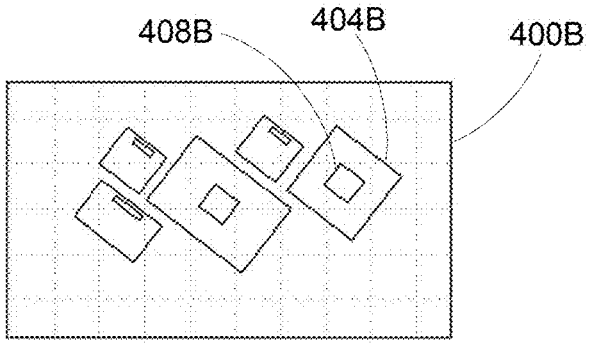

FIG. 4B shows poster 400B as supplied to a user, which is poster 400A rotated so that its sides are parallel or perpendicular to the ground. The poster's frames and windows 404B and 408B are then slanted relative to a side of the poster, and will be leveled with the ground when poster 400B is attached to the wall in parallel to staircase 410.

Posters Made of a Number of Sheets

FIG. 5 schematically illustrates several examples of posters made of one or more sheets of paper or another suitable substrate that can be printed, cut and folded similarly to paper. Poster 500A is composed of a single sheet in landscape orientation. Poster 500B is composed of a single sheet in portrait orientation. Poster 500C is composed of a single sheet in slanted orientation, demonstrating the poster adhered to a wall for mounting a collage next to a staircase as in FIG. 4A. Poster 500D and poster 500E demonstrate two examples of posters composed of multiple sheets that are combined into a single operative poster either by stitching the sheets prior to shipping them to the user, or by the user attaching the separate sheets to the wall side-by-side.

Types of Adhesive Tile Positioning Plates

FIG. 6 summarizes four examples of adhesive tile positioning plates usable for conveniently and accurately adhering collage tiles to a wall. Adhesive magnetic wall plate 600W has been described above as adhesive magnetic wall plate 120L, 120M and 120N with reference to FIG. 2C, and as adhesive magnetic wall plate 160L, 160M and 160N, with reference to FIG. 2D. Such adhesive magnetic wall plates are positioned and adhered to the wall accurately, guided by the respective windows of the respective posters. Having an adhesive magnetic wall plate 600W adhered to the wall, a respective magnetic tile plate affixed to a tile mates with the adhesive magnetic wall plate to accurately position the tile in place.

A second example is adhesive mounting plate 600P, which has been described above as adhesive mounting plate 180L, 180M and 180N with reference to FIG. 2F, using poster windows for accurately positioning double-sided adhesive plates on a wall for mounting a collage of plain picture tiles on the wall.

A third example is adhesive tile edge marker 600M, which implements adhesive tile edge marker 300M of FIG. 3E for the collage mounting scenario depicted with reference to FIGS. 3A-3D above.

A fourth example is adhesive tile edge block 600B, which implements adhesive tile edge block 300B of FIG. 3E for the collage mounting scenario depicted with reference to FIGS. 3A-3D above.

While the invention has been described with respect to a limited number of embodiments, it will be appreciated by persons skilled in the art that the present invention is not limited by what has been particularly shown and described herein. Rather the scope of the present invention includes both combinations and sub-combinations of the various features described herein, as well as variations and modifications which would occur to persons skilled in the art upon reading the specification and which are not in the prior art.

What is claimed is:

1. A kit for assisting a user in mounting multiple tiles of a collage on a wall, the kit comprising:

the multiple tiles;

a plurality of adhesive plates for adhering said tiles to the wall;

a poster exhibiting a full-size layout of the collage, the layout comprising a plurality of printed frames depicting the multiple tiles, the poster comprising, for each printed frame of the plurality of printed frames, a window that is cut out through the poster and externally touches a peripheral edge of said printed frame; and a plurality of adhesive tile positioning guides, each adhesive tile positioning guide configured for:

(i) being removably adhered to the wall through one of said window cut out through the poster, (ii) guiding the user in positioning a tile of the multiple tiles on the wall adjacent to the adhesive tile positioning guide when adhering said tile to the wall using one of the plurality of adhesive plate, and (iii) being removed from the wall while leaving said tile mounted on the wall.

2. The kit of claim 1, wherein each said adhesive tile positioning guide is an adhesive tile edge marker for visually marking on the wall a position of an edge of a tile.

3. The kit of claim 1, wherein the poster is composed of a single sheet.

4. The kit of claim 1, wherein the poster is composed of multiple sheets.

5. The kit of claim 1 for mounting the collage on a wall next to a staircase or slanted ramp, wherein each said window is slanted relative to a side edge of the poster.

6. The kit of claim 1, further comprising a mounting guidance page that shows a snapshot of the collage in which each tile of the collage is exhibiting a picture.

7. A kit for assisting a user in mounting multiple tiles of a collage on a wall, the kit comprising:

the multiple tiles;

a plurality of adhesive plates for adhering said tiles to the wall;

a poster exhibiting a full-size layout of the collage, the layout comprising a plurality of printed frames depicting the multiple tiles, the poster comprising, for each printed frame of the plurality of printed frames, a window that is cut out through the poster and externally touches a peripheral edge of said printed frame; and a plurality of adhesive tile edge block blocks, each adhesive tile edge block configured for:

(i) being removably adhered to the wall through one of said window cut out through the poster, (ii) protruding from the wall to guide the user in abutting a tile of the multiple tiles adjacent to the adhesive tile edge block when adhering said tile to the wall using an adhesive plate of the plurality of adhesive plates, and (iv) being removed from the wall while leaving said tile mounted on the wall.

8. The kit of claim 7, wherein each said adhesive tile edge block is at least 2 mm thick.

9. The kit of claim 7 for mounting the collage on a wall next to a staircase or slanted ramp, wherein said window is slanted relative to a side of the poster.

10. The kit of claim 7 for mounting the collage on a wall next to a staircase or slanted ramp, wherein each of said windows are slanted relative to a side edge of the poster.

11. The kit of claim 7, wherein the poster is composed of multiple sheets.

12. A method for mounting multiple tiles of a collage on a wall, the method comprising:

obtaining a poster that exhibits a full-size layout of the collage, the layout showing the multiple tiles as frames;

attaching the poster to the wall;

picking a tile of the multiple tiles;

adhering to the wall an adhesive tile positioning guide, through a window that is cut out through the poster and externally touches a frame of the layout that shows said tile;

removing the poster from the wall;

positioning said tile on the wall adjacent to said adhesive tile positioning guide;

adhering said tile to the wall; and removing said adhesive tile positioning guide from the wall while leaving said tile mounted on the wall.

* * * * *